US011153940B2

(12) United States Patent
Burdio Pinilla et al.

(10) Patent No.: US 11,153,940 B2
(45) Date of Patent: Oct. 19, 2021

(54) DOMESTIC APPLIANCE DEVICE

(71) Applicant: BSH Hausgeräte GmbH, Munich (DE)

(72) Inventors: José Miguel Burdio Pinilla, Saragossa (ES); Tomas Cabeza Gozalo, Saragossa (ES); Sergio Llorente Gil, Saragossa (ES); Oscar Lucia Gil, Saragossa (ES); Ignacio Millan Serrano, Saragossa (ES); Alejandro Naval Pallares, Huesca (ES); Hector Sarnago Andia, Olvega (ES)

(73) Assignee: BSH Hausgeräte GmbH, Munich (DE)

( * ) Notice: Subject to any disclaimer, the term of this patent is extended or adjusted under 35 U.S.C. 154(b) by 416 days.

(21) Appl. No.: 16/334,030

(22) PCT Filed: Dec. 12, 2017

(86) PCT No.: PCT/IB2017/057812

§ 371 (c)(1),
(2) Date: Mar. 18, 2019

(87) PCT Pub. No.: WO2018/116053

PCT Pub. Date: Jun. 28, 2018

(65) Prior Publication Data

US 2019/0274190 A1 Sep. 5, 2019

(30) Foreign Application Priority Data

Dec. 19, 2016 (ES) ..... ES201631615

(51) Int. Cl.
*H05B 6/06* (2006.01)
*H05B 1/02* (2006.01)

(52) U.S. Cl.
CPC ..... *H05B 6/065* (2013.01); *H05B 1/0202* (2013.01); *H05B 6/062* (2013.01); *H05B 2213/03* (2013.01); *H05B 2213/05* (2013.01)

(58) Field of Classification Search
CPC ..... H05B 1/0202; H05B 2213/03; H05B 2213/05; H05B 6/062; H05B 6/065
(Continued)

(56) References Cited

U.S. PATENT DOCUMENTS 5,658,478 A * 8/1997 Roeschel ..... F24C 3/126 219/502
6,614,006 B2 9/2003 Gerola et al.
(Continued)

FOREIGN PATENT DOCUMENTS

CN 104754789 A 7/2015
CN 205454134 U 8/2016
(Continued)

OTHER PUBLICATIONS

National Search Report CN 201780078383.6 dated Dec. 15, 2020.
(Continued)

*Primary Examiner* — Quang T Van
(74) *Attorney, Agent, or Firm* — Michael E. Tschupp; Andre Pallapies; Brandon G. Braun

(57) ABSTRACT

A household appliance device includes an integer number N of row switching elements at a row position i, wherein i is an integer number 1≤i≤N, an integer number M of column switching elements at a column position j, wherein j is an integer number 1≤j≤M, a heating matrix including at least N×M heating matrix elements having positions (i,j), with N+M>2, wherein a heating matrix element at the position (i,j) includes at least one inductor at the position (i,j) and is connected to both the i-th row switching element and the j-th column switching element. At least one switching diode connects at least one of the row switching elements or at least one of the column switching elements to at least one reference potential.

20 Claims, 8 Drawing Sheets

(58) Field of Classification Search
USPC ..... 219/626, 627, 620, 662, 665, 506, 507, 219/518, 502, 447.1, 448.11, 494; 126/1 R; 236/1 R; 338/22 R
See application file for complete search history.

(56) References Cited

U.S. PATENT DOCUMENTS

| | | | | |
|---|---|---|---|---|
| 10,002,779 | B2 | 6/2018 | Swanson et al. | |
| 2002/0053563 | A1* | 5/2002 | Pastore | H05B 3/746 219/448.11 |
| 2004/0144769 | A1 | 7/2004 | Pastore | |
| 2011/0272397 | A1 | 11/2011 | Artal Lahoz et al. | |
| 2012/0205365 | A1* | 8/2012 | Anton Falcon | H05B 6/065 219/620 |
| 2016/0037585 | A1 | 2/2016 | Christiansen et al. | |
| 2016/0150600 | A1 | 5/2016 | Lomp et al. | |

FOREIGN PATENT DOCUMENTS

| | | | |
|---|---|---|---|
| DE | 102012201236 | A1 | 8/2012 |
| DE | 102011087216 | A1 | 5/2013 |
| EP | 0862174 | A1 | 9/1998 |
| EP | 1303168 | A1 | 4/2003 |
| EP | 2680668 | A1 | 1/2014 |
| EP | 2914060 | A1 | 9/2015 |
| EP | 2928265 | A1 | 10/2015 |
| WO | 9719298 | A1 | 5/1997 |
| WO | 2014064931 | A1 | 5/2014 |
| WO | 2015015375 | A1 | 2/2015 |
| WO | 2016010492 | A1 | 1/2016 |

OTHER PUBLICATIONS

International Search Report PCT/IB2017/057812 dated Mar. 8, 2018.
National Search Report ES P201631615 dated Oct. 24, 2017.

* cited by examiner

DOMESTIC APPLIANCE DEVICE

CROSS-REFERENCES TO RELATED APPLICATIONS

This application is the U.S. National Stage of International Application No. PCT/IB2017/057812, filed Dec. 12, 2017, which designated the United States and has been published as International Publication No. WO 2018/116053 A1 and which claims the priority of Spanish Patent Application, Serial No. P201631615, filed Dec. 19, 2016, pursuant to 35 U.S.C. 119(a)-(d).

BACKGROUND OF THE INVENTION

The invention relates to a household appliance device.

A household appliance device with at least one inverter unit with a half bridge circuit or full bridge circuit design for operating multiple inductors by means of a multiplexer is already known from the prior art.

BRIEF SUMMARY OF THE INVENTION

It is the object of the invention in particular to provide a generic device with improved properties in respect of efficiency.

A household appliance device, in particular a cooking appliance device and preferably a cooktop device, is proposed, with at least a number N of row switching elements, with at least a number M of column switching elements and with at least one heating matrix, which has at least one, in particular just one, number N×M of heating matrix elements, wherein, for any i from 1 to N and any j from 1 to M with a total number N+M of column switching elements and row switching elements greater than 2, the heating matrix element at position i,j comprises at least one, preferably just one, inductor at position i,j and is connected to both the i-th row switching element and the j-th column switching element, and with at least one switching diode, which connects at least one of the row switching elements or at least one of the column switching elements to at least one reference potential.

A "household appliance device" in this context refers in particular to at least one part, preferably at least one subassembly, of a household appliance. The household appliance device can in particular also comprise the entire household appliance. The household appliance is configured in particular as a cooking appliance, preferably a microwave, an oven and/or an, in particular variable, cooktop, in particular a matrix cooktop, and particularly preferably as an inductive cooking appliance, for example in particular an induction oven and/or preferably an induction cooktop, in particular a matrix induction cooktop. A "cooking appliance device" refers in particular to a household appliance device, which at least partially forms a cooking appliance. A "variable cooktop" in this context refers in particular to a cooktop, in which inductors are arranged, in particular in a regular spatial arrangement, in particular below a cooktop plate of the household appliance device and at least partially form at least one heating zone, preferably multiple variable heating zones, which comprise(s) a region of the cooktop plate preferably of at least 10%, more preferably at least 30% and particularly advantageously at least 40% of an overall area of the cooktop plate. In particular the inductors are provided to form the heating zone as a function of a position of a cookware item positioned on the cooktop plate and to tailor it to the cookware item. "Provided" in particular means specifically programmed, designed and/or equipped. That an object is provided for a specific function means in particular that the object fulfills and/or performs said specific function in at least one application and/or operating state. A "number" in this context means in particular any number from the set of natural numbers. It should always be the case in particular that the total number N+M of column switching elements and row switching elements is greater than 2, when the number N of row switching elements and/or the number M of column switching elements is greater than 1. A "row switching element" and/or a "column switching element" in this context refers in particular to switching elements which are assigned to rows and/or columns of a grid of a schematic circuit arrangement and/or define such. The schematic circuit arrangement is in particular different from a spatial arrangement, in which the column switching elements and row switching elements can be arranged in an in particular particularly compact arrangement as preferred by the person skilled in the art. The row switching elements are in particular connected to a reference potential that is common to the row switching elements. The reference potential common to the row switching elements is in particular an operating potential of an operating voltage, with which the household appliance device is operated. The reference potential common to the row switching elements here is in particular a ground potential. The column switching elements are in particular connected to a further reference potential that is common to the column switching elements. The further reference potential common to the column switching elements is in particular a further operating potential of the operating voltage. The further reference potential common to the column switching elements is in particular different from a ground potential. In particular an operating voltage is present between the reference potential common to the row switching elements and the further reference potential common to the column switching elements. A "switching element" in this context refers in particular to an element, which is provided to connect a first connection to at least one second connection in an electrically conducting manner in at least one first switching state and to disconnect the first connection from the second connection in at least one second switching state. The switching element in particular has at least one control connection, by way of which the switching state of the switching element can be controlled. The switching element is provided in particular to transition from one of the switching states to the other switching state respectively in a switching operation. The switching element here can be configured as any switching element, preferably a semiconductor switching element, that appears expedient to the person skilled in the art, for example as a transistor, preferably as a FET, MOSFET and/or IGBT, preferably as an RC-IGBT and particularly preferably as a HEMT transistor. A "HEMT transistor" refers in particular to a High Electron Mobility Transistor, in particular with a particularly high level of electron mobility, which in particular at 25° C. is in particular at least 400 $cm^2V^{-1}s^{-1}$, preferably at least 600 $cm^2V^{-4}s^{-1}$, more preferably at least 800 $cm^2V^{-1}s^{-1}$ and particularly preferably at least 1000 $cm^2V^{-1}s^{-1}$. HEMT transistors also refer in particular to Modulation Doped Field Effect Transistors (MODFET), Two Dimensional Electron Gas Field Effect Transistors (TEGFET), Selectively Doped Heterojunction Transistors (SDHT) and/or Heterojunction Field Effect Transistors (HFET). The switching element in particular has at least one first connection, which is preferably a source connection, a second connection, which is preferably a drain connection, and/or a control connection, which is in particular a gate connection. At least one diode, in particular a feedback diode, and/or at least one capacitance, in particular a damping capacitance, of the household appliance, can be connected parallel to the switching element. At least one i-th row switching element and at least one j-th column switching element, which are connected in particular in a full bridge topology or preferably a half bridge topology, serve in particular as inverter switching elements and together form at least partially, preferably completely, an inverter unit at position i,j of the household appliance device. The household appliance device comprises in particular a number N×M of inverter units. An "inverter unit at position i,j" refers in particular to a unit, which is provided to supply and/or generate a high-frequency heating current, preferably with a frequency of at least 1 kHz, in particular at least 10 kHz and advantageously at least 20 kHz, in particular to operate the inductor at position i,j. The household appliance device in particular has a control unit, which is provided to activate the row switching elements and the column switching elements. A "control unit" refers in particular to an electronic unit, which is preferably at least partially integrated in a control and/or regulation unit of a household appliance. The control unit preferably comprises a computation unit and in particular, in addition to the computation unit, a storage unit with a control and/or regulation program stored therein, which is provided to be run by the computation unit. The control unit is particularly advantageously provided to activate the row switching elements and the column switching elements as inverter switching elements, in particular such that a soft switching operation takes place between at least one first switching state and a second switching state of the switching elements. A "soft switching operation" refers in particular to a switching operation with a vanishingly small power loss, which takes place in particular when the switching operation is preferably at least essentially voltage-free. An "at least essentially voltage-free switching operation", also known as "zero voltage switching (ZVS)", refers in particular to a soft switching operation, in which a voltage, which is present and/or drops in particular immediately before a switching operation at the heating matrix element at position i,j and in particular at the inductor at position i,j, is at least essentially vanishingly low, in particular essentially zero. The control unit is provided in particular to switch the switching elements during an at least essentially voltage-free switching operation with a switching frequency, which is greater than a resonant frequency of the heating matrix element at position i,j. A "vanishingly low value" refers in particular to a value which is in particular at least a factor 10, preferably at least a factor 50, more preferably at least a factor 100 and particularly preferably at least a factor 500 lower than an operating maximum value. A "heating matrix" refers in particular to a grid of a schematic circuit arrangement of heating matrix elements at position i,j. The heating matrix element at position i,j is in particular connected at least indirectly and preferably directly to both the i-th row switching element and the j-th column switching element. That "at least two electrical components are connected directly to one another" in this context means in particular that a connection between the electrical components is free of at least a further electrical component, which changes a phase between a current and a voltage and/or preferably a current and/or voltage itself. The inductor at position i,j particularly preferably has at least one, in particular just one, connection at position i,j, which is connected to both the i-th row switching element, in particular to a first connection of the i-th row switching element, and also the j-th column switching element, in particular a second connection of the j-th column switching element. An "inductor" refers in particular to an electrical component, which is provided in at least one cooking operating state at least partially to heat at least one cookware item positioned on the cooktop plate of the household appliance device inductively. The inductor comprises at least one wound electrical conductor, preferably in the form of a circular disk, through which a high-frequency heating current flows in the cooking operating state at least. The inductor is preferably provided to convert electrical energy to an alternating magnetic field in order to induce eddy currents and/or magnetic reversal effects, which are converted to heat, in the cookware item.

A corresponding configuration can advantageously provide a household appliance device with improved properties in respect of efficiency, in particular cost efficiency and/or energy efficiency. A particularly soft and therefore more energy-efficient switching operation can advantageously be achieved. In particular the number of switching elements can be reduced, as some switching elements operate multiple inductors, thereby reducing component costs. Different inductors in the heating matrix can also advantageously be activated individually, thereby reducing energy consumption and in particular reducing any electrical scatter field. The arrangement cited above particularly advantageously allows the switching elements to be switched softly, in particular in an at least essentially voltage-free manner, thereby reducing switching losses. It also allows advantageous detection of cookware items, thereby removing the need for additional components, such as sensor elements for example.

In order to reduce the space required for the inductors and in particular to achieve an efficient spatial arrangement of inductors for a cooking operation with cookware items, it is further proposed that the inductors are arranged spatially in an inductor matrix which differs, in respect of the proximity relationship of at least two of the inductors relative to one another, from the heating matrix in which the inductors are arranged in a schematic circuit. An "inductor matrix" refers in particular to a grid of a spatial arrangement of the inductors below a cooktop plate of the household appliance device. A "different proximity relationship" means in particular that nearest neighbors of inductors at position i,j in the inductor matrix are not nearest neighbors of inductors at position i,j in the heating matrix.

In one preferred configuration of the invention it is proposed that in the inductor matrix the inductors are arranged spatially such that at least one inductor at position i,j, for which i=j in the heating matrix, is adjacent to at least one inductor at position i,j, for which i≠j in the heating matrix. An "inductor at position i,j, for which i=j in the heating matrix" refers in particular to a diagonal inductor arranged on a diagonal of the heating matrix. An "inductor at position i,j for which i≠j in the heating matrix" refers in particular to an off-diagonal inductor, which is arranged away from a diagonal of the heating matrix. Preferably arranged between at least two inductors at position i,j, for which i=j in the heating matrix, is at least one inductor at position i,j, for which i≠j in the heating matrix. An inductor at position i,j, for which i=j in the heating matrix, is particularly preferably surrounded, preferably surrounded in a circular manner, by multiple, in particular at least three, preferably at least four and particularly preferably at least five inductors at position i,j, for which i≠j in the heating matrix. Alternatively it is conceivable for the heating matrix to be free of heating matrix elements at position i,j and in particular inductors at position i,j, for which i=j in the heating matrix. This further simplifies activation of the household appliance device, as simultaneous operation of diagonal inductors in particular can be avoided.

In one particularly preferred configuration of the invention it is proposed that in the inductor matrix inductors at position i,j of identical i or identical j are adjacent and preferably directly adjacent to one another. In particular the inductors at position i,j of identical i or identical j are arranged in the same row or column of the heating matrix. In particular the inductors at position i,j of identical i or j are arranged grouped together and form in particular at least partially, preferably at least largely and particularly preferably completely at least one heating zone for a cookware item. More preferably inductors at position i,j of different i or j at least partially form different heating zones. This further simplifies activation of the household appliance device, as simultaneous operation of at least two inductors at position i,j, for which i=j in the heating matrix, can be particularly advantageously avoided.

It is conceivable for the total number N+M of column switching elements and row switching elements to be smaller than or equal to the number N×M of heating matrix elements. In order to operate a number N×M of heating matrix elements with the smallest possible total number N+M of column switching elements and row switching elements and advantageously to reduce component costs, it is proposed that the number N of column switching elements is equal to the number M of row switching elements. In particular the heating matrix is then configured as a quadratic matrix.

In order to exclude unwanted activation of at least two diagonal inductors, it is proposed that the total number N+M of column switching elements and row switching elements is one greater than the number N×M of heating matrix elements. The heating matrix is then configured in particular as a vector, preferably a row vector, in particular when the number N of row switching elements is equal to 1 or as a column vector, in particular when the number M of column switching elements is equal to 1.

It is also proposed that the heating matrix element at position i,j has at least one diode at position i,j, by means of which the inductor at position i,j is connected at least to the i-th row switching element. In particular the diode at position i,j is connected to the connection at position i,j between the inductor at position i,j and the i-th row switching element. The inductor at position i,j in particular allows a current flow in the direction of the i-th row switching element and preferably blocks a current flow in the direction of the inductor at position i,j. The diode at position i,j can be dispensed with, particularly when the number of row switching elements is equal to 1. Also a backflow diode and/or a damping capacitor of the household appliance device in particular could be connected parallel to the j-th column switching element. Also advantageously the heating matrix element at position i,j has at least one further diode at position i,j, by means of which the inductor at position i,j is connected at least to the j-th column switching element. In particular the further diode at position i,j is connected to the connection at position i,j between the inductor at position i,j and the j-th column switching element. The diode at position i,j in particular allows a current flow in the direction of the inductor at position i,j and preferably blocks a current flow in the direction of the j-th column switching element. Also the further diode at position i,j can be dispensed with, when the number M of column switching elements is equal to 1. Also a backflow diode and/or a damping capacitor in particular could be connected parallel to the i-th row switching element. This in particular prevents an uncontrolled current flow in particular between multiple heating matrix elements.

It is further proposed that the heating matrix element at position i,j has at least one capacitance at position i,j, by means of which the inductor at position i,j is connected at least to at least one reference potential common to the heating matrix elements. The reference potential common to the heating matrix elements is in particular the operating potential. The heating matrix element at position i,j also has in particular at least one further capacitance at position i,j, by means of which the inductor at position i,j is connected at least to at least one further reference potential common to the heating matrix elements. The further reference potential common to the heating matrix elements is in particular the further operating potential. The capacitance at position i,j comprises at least one capacitor. The capacitance can preferably comprise multiple capacitors, in particular a capacitor network, which is preferably made up of at least some capacitors connected in series and/or some connected in a parallel manner. The capacitance can also be settable in particular. The inductor at position i,j has in particular at least one further connection at position i,j, which is connected to both the capacitance at position i,j and the further capacitance at position i,j. This advantageously allows a natural frequency of an oscillating circuit of the household appliance device to be matched to the field of application by selecting the capacitances correspondingly.

It is further proposed that the heating matrix comprises a number N of row diodes, the i-th row diode connecting at least the i-th row switching element to at least one further reference potential common to the row switching elements, in particular the further operating potential. In particular if the switching diode connects the i-th row switching element to a reference potential common to the row switching elements, the switching diode is the i-th row diode. It is further proposed that the heating matrix comprises a number M of column diodes, the j-th column diode connecting at least the j-th column switching element to at least one reference potential common to the column switching elements, in particular the operating potential. In particular if the switching diode connects the j-th column switching element to a reference potential common to the column switching elements, the switching diode is the j-th column diode. This allows a particularly soft switching operation to be achieved.

It is further proposed that in at least one cookware detection mode, when an operating voltage has an at least essentially vanishingly low value, the control unit is provided to determine at least one electrical characteristic variable occurring at at least one of the inductors. The electrical characteristic variable is preferably correlated with an electromagnetic coupling of the inductor to a cookware item, in particular with a degree of cover and/or a material of the cookware item. In particular the control unit can deduce and preferably determine the electromagnetic coupling of the inductor to the cookware item at least from the electrical characteristic variable. The electrical characteristic variable corresponds in particular to a direct control variable. The electrical characteristic variable is advantageously an electrical signal and/or electronic signal, in particular one measured by a sensor unit of the household appliance device. The electrical characteristic variable is preferably a frequency, amplitude and/or phase of a voltage present at the inductor and/or of a current flowing through the inductor. This improves the flexibility of the household appliance device, as cookware items can be detected.

It is further proposed that in cookware detection mode the control unit is provided first to charge the inductor and then, when an operating voltage has an at least essentially vanishingly low value, to discharge it again. In cookware detection mode the control unit is advantageously provided to acquire a characteristic line of a discharging operation of the inductor and to use this characteristic line to determine the electrical characteristic variable. The characteristic line is in particular a time profile of the electrical characteristic variable. In particular the control unit is provided to determine the electrical characteristic value by tailoring a comparative characteristic line to the characteristic line, in particular based on parameters for generating the comparative characteristic line. This allows easy discharging of the inductor, avoiding short circuits with further electrical components.

The household appliance device here should in particular not be limited to the application and embodiment described above. In particular the household appliance device can have a different number of individual elements, components and units from the number cited herein to achieve a mode of operation described herein. In respect of the value ranges cited in this disclosure, values within the cited limits should also preferably be deemed to be disclosed and applicable in any manner.

Further advantages will emerge from the description of the drawing that follows. The drawing shows a number of exemplary embodiments of the invention. The drawing, description and claims container numerous features in combination. The person skilled in the art will also expediently consider the features individually and combine them in useful further combinations.

DETAILED DESCRIPTION OF EXEMPLARY EMBODIMENTS OF THE PRESENT INVENTION

Figure 1:
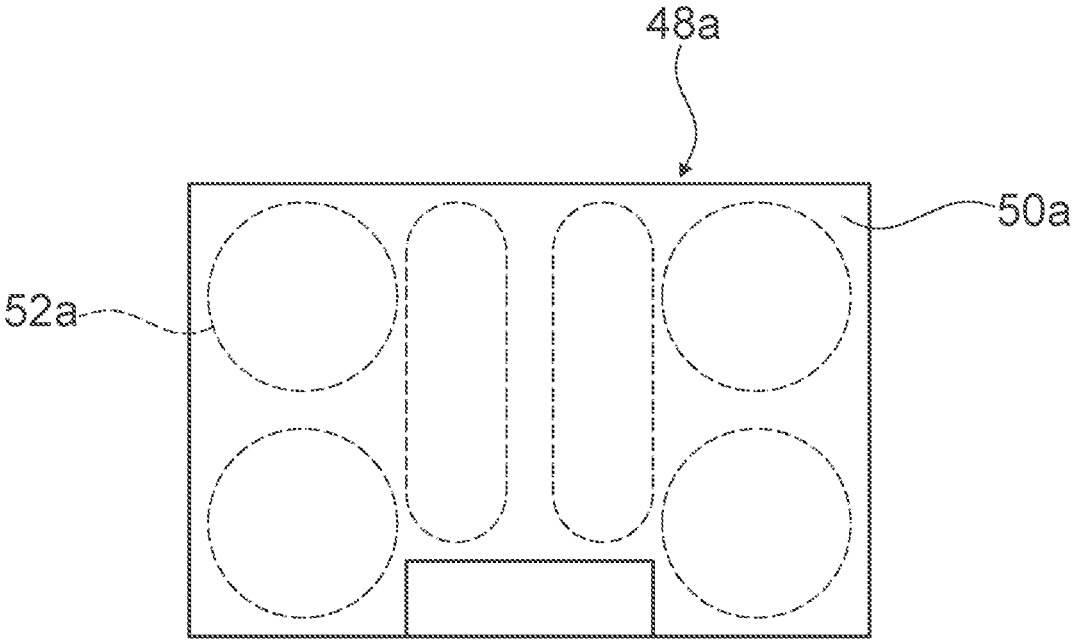
FIG. 1 shows a schematic view from above of a household appliance with a household appliance device.

FIG. 1 shows a schematic view from above of a household appliance 48*a* with a household appliance device. In the present instance the household appliance 48*a* is configured as a cooking appliance. The household appliance 48*a* is a cooktop, in particular a variable induction cooktop. Alternatively the household appliance 48*a* can be configured as any household appliance 48*a*, in particular a cooking appliance, that is different from a cooktop, and in particular appears advantageous to the person skilled in the art, for example a microwave or induction oven.

The household appliance device has a cooktop plate 50*a*. The household appliance device is provided to operate at least one cookware item, which is arranged in any position on the cooktop plate 50*a*. The cooktop plate 50*a* comprises preferred heating zone positions 52*a*, which characterize preferred positions for cookware items. In the present instance the cooktop plate 50*a* has six preferred heating zone positions 52*a*. Only one of the preferred heating zone positions 52*a* is shown with a reference character for greater clarity. The cooktop plate 50*a* can in particular have any number of preferred heating zone positions 52*a* or no preferred heating zone positions 52*a*.

Figure 2:
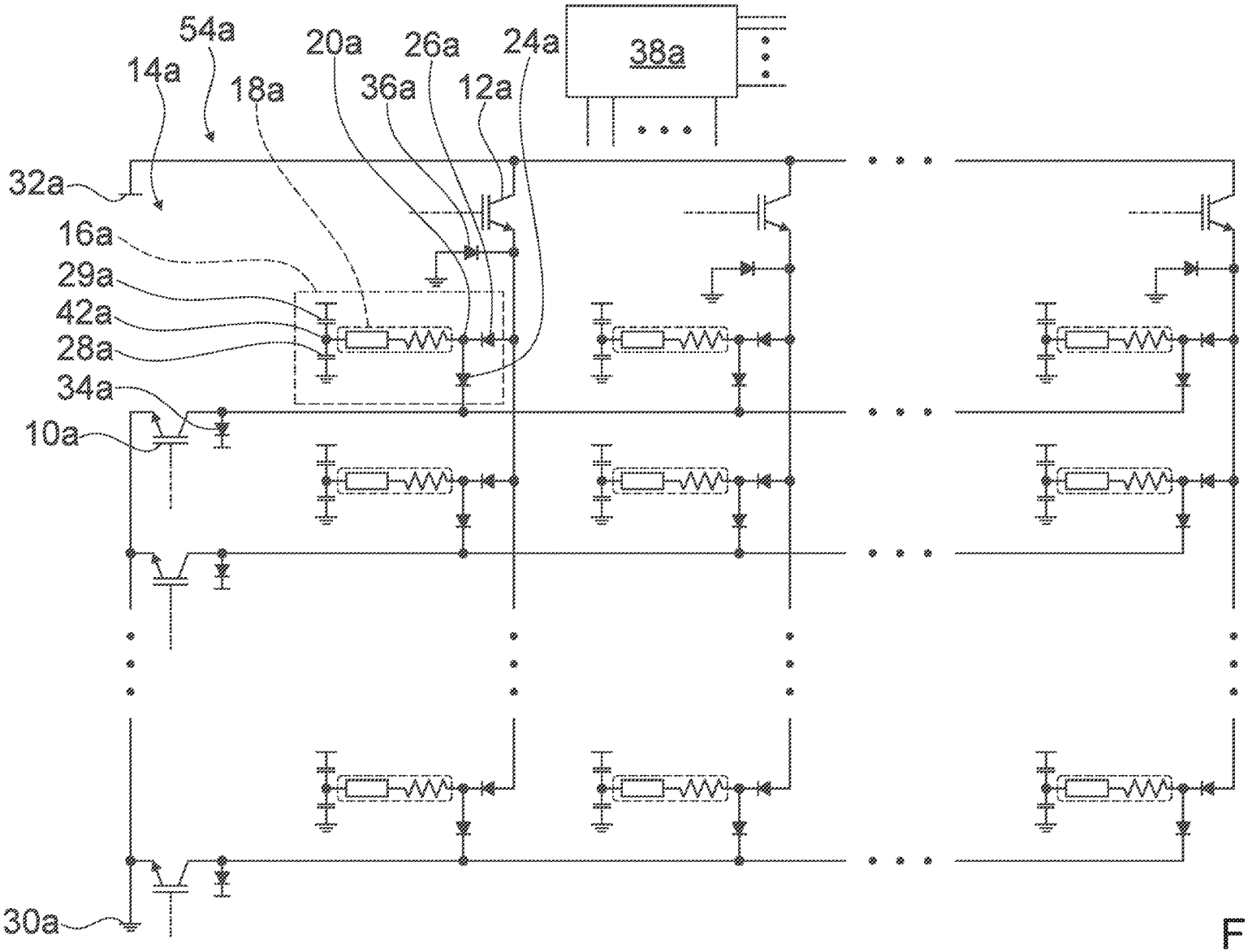
FIG. 2 shows a schematic circuit diagram of a part of the household appliance device with a heating matrix.

FIG. 2 shows a schematic circuit diagram of a part of the household appliance device. The household appliance device comprises at least a number N of row switching elements 10*a*. The household appliance device also comprises at least a number M of column circuit elements 12*a*. The household appliance device comprises at least one heating matrix 14*a*. The heating matrix 14*a* has at least one heating matrix element 16*a* at position i,j for any i from 1 to N and any j from 1 to M. The heating matrix 14*a* has a number N×M of heating matrix elements 16*a*. A total number N+M of row switching elements 10*a* and column switching elements 12*a* is greater than 2. The total number N+M of row switching elements 10*a* and column switching elements 12*a* is smaller than or equal to the number N×M of heating matrix elements 16*a*. In the present instance the household appliance device has a number N=8 of row switching elements 10*a*. In the present instance the household appliance device has a number N=3 of column switching elements 12*a*. The household appliance device also has a number N×M=24 of heating matrix elements 16*a*. It is however conceivable for N and/or M to be any other natural number deemed particularly advantageous by a person skilled in the art. Alternatively or additionally a number N can be selected to be equal to a number M or such that the total number N+M is one greater than the number N×M.

An, in particular schematic circuit-type, arrangement of the electrical components of the household appliance device is described by way of example below with reference to i-th and j-th components of the household appliance device as well as those at position i,j. The following descriptions here also apply to further, equivalent electrical components.

The i-th row switching element 10*a* is configured as a transistor. The i-th row switching element 10*a* has a first connection. The first connection is a source connection. The first connection of the i-th row switching element 10*a* is connected to the heating matrix element 16*a* at position i,j. The i-th row switching element 10*a* has a second connection. The second connection is a drain connection. The second connection of the i-th row switching element 10*a* is connected to a reference potential 30*a* common to the row switching elements 10*a*. The reference potential 30*a* common to the row switching elements 10*a* is an operating potential of an operating voltage, preferably a ground potential. The household appliance device in particular has a rectifier, which converts a network voltage at least partially to the operating voltage. The operating voltage here is the voltage present between the reference potential 30*a* common to the row switching elements 10*a* and a further reference potential 32*a* common to the column switching elements 12*a*. The i-th row switching element 10*a* has a control connection. The control connection is a gate connection. The control connection is connected to a control unit 38*a* of the household appliance device.

The j-th column switching element 12*a* is configured as a transistor. The j-th column switching element 12*a* has a first connection. The first connection is a source connection. The first connection of the j-th column switching element 12*a* is connected to the further reference potential 32*a* common to the column switching elements 12*a*. The further reference potential 32*a* common to the column switching elements 12*a* is the further operating potential. The j-th column switching element 12*a* has a second connection. The second connection is a drain connection. The second connection of the j-th column switching element 12*a* is connected to the heating matrix element 16*a* at position i,j. The j-th column switching element 12*a* has a control connection. The control connection is a gate connection. The control connection is connected to the control unit 38*a* of the household appliance device.

The i-th row switching element 10*a* and the j-th column switching element 12*a* are arranged in a half bridge topology. It is conceivable for the household appliance device to comprise i-th further row switching elements 10*a* and j-th further column switching elements 12*a*, so the i-th row switching elements 10*a*, the i-th further row switching elements 10*a*, the j-th column switching elements 12*a* and the j-th further column switching elements 12*a* can be arranged in a full bridge topology.

The i-th row switching element 10*a* and the j-th column switching element 12*a* serve as inverter switching elements. The i-th row switching element 10*a* and the j-th column switching element 12*a* together form at least one inverter unit 54*a* at position i,j of the household appliance device. The household appliance device in particular comprises a number N×M of inverter units 54*a*. The control unit 38*a* is provided to activate the i-th row switching element 10*a* and the j-th column switching element 12*a* as inverter switching elements. The control unit 38*a* activates the i-th row switching element 10*a* and the j-th column switching element 12*a* in such a manner that a soft switching operation takes place between at least one first switching state and a second switching state of the i-th row switching element 10*a* and the j-th column switching element 12*a*.

The heating matrix element 16*a* at position i,j has at least one inductor 1*a* at position i,j. The inductor 18*a* at position i,j is connected to both the i-th row switching element 10*a* and the j-th column switching element 12*a*. The inductor 18*a* at position i,j has at least one connection 20*a* at position i,j. The connection 20*a* at position i,j is connected to both the i-th row switching element 10*a*, in particular the first connection of the i-th row switching element 10*a*, and the j-th column switching element 12*a*, in particular the second connection of the j-th column switching element 12*a*. A total N×M of inductors 18*a* are arranged in a schematic circuit in the heating matrix 14*a*.

The heating matrix element 16*a* at position i,j has at least one diode 24*a* at position i,j. The inductor 18*a* at position i,j is connected at least to the i-th row switching element 10*a* by means of the diode 24*a* at position i,j. A first connection of the diode 24*a* at position i,j is connected to the connection 20*a* at position i,j of the inductor 18*a* at position i,j. A second connection of the diode 24*a* at position i,j is connected to a first connection of the i-th row switching element 10*a*. The diode 24*a* at position i,j allows a current flow in the direction of the i-th row switching element 10*a*. The diode 24*a* at position i,j blocks a current flow in the direction of the inductor 18*a* at position i,j.

The heating matrix element 16*a* at position i,j has at least one further diode 26*a* at position i,j. The inductor 18*a* at position i,j is connected at least two the j-th column switching element 12*a* by means of the further diode 26*a* at position i,j. A first connection of the further diode 26*a* at position i,j is connected to the connection at position i,j of the inductor 18*a* at position i,j. A second connection of the further diode 26*a* at position i,j is connected to the second connection of the j-th column switching element 12*a*. The further diode 26*a* at position i,j allows a current flow in the direction of the inductor 18*a* at position i,j. The further diode 26*a* at position i,j blocks a current flow in the direction of the j-th column switching element 12*a*.

The heating matrix element 16*a* at position i,j has at least one capacitance 28*a* at position i,j. The capacitance 28*a* at position i,j is a capacitor. The inductor 18*a* at position i,j is connected at least to a reference potential 30*a* common to the heating matrix elements 16*a* by means of the capacitance 28*a* at position i,j. The reference potential 30*a* common to the heating matrix elements 16*a* is the operating potential. A first connection of the capacitance 28*a* at position i,j is connected to a further connection 42*a* at position i,j of the inductor 18*a* at position i,j. A second connection of the capacitance 28*a* at position i,j is connected to the common reference potential 30*a*.

A heating matrix element 16*a* at position i,j has at least one further capacitance 29*a* at position i,j. The further capacitance 29*a* at position i,j is a capacitor. An inductor 18*a* at position i,j is connected at least to a further reference potential 32*a* common to the heating matrix elements 16*a* by means of the further capacitance 29*a* at position i,j. The further reference potential 32*a* common to the heating matrix elements 16*a* is a further operating voltage. A first connection of the further capacitance 28*a* at position i,j is connected to a further connection 42*a* at position i,j of the inductor 18*a* at position i,j. A second connection of the capacitance 28*a* at position i,j is connected to the further reference potential 32*a* common to the heating matrix elements 16*a*. Alternatively or additionally the capacitance 28*a* at position i,j can be configured as a capacitor network, which comprises multiple capacitors connected in series and/or in a parallel manner.

The household appliance device has a number M of column diodes 36*a*. The j-th column diode 36*a* connects at least one j-th column switching element 12*a* to at least one reference potential 30*a* common to the column switching elements 12*a*. The reference potential 30*a* common to the column switching elements 12*a* is equal to a reference potential 30*a* common to the row switching elements 10*a*. A first connection of the j-th column switching element 12*a* is connected to a further reference potential 32*a* common to the column switching elements 12*a*. A second connection of the j-th column switching element 12*a* is connected to a first connection of a j-th column diode 36*a*. The j-th column diode 36*a* blocks a current in the direction of the reference potential 30*a* common to the column switching elements 12*a*. The j-th column diode 36*a* allows a current from the direction of the reference potential 30*a* common to the column switching elements 12*a*.

The household appliance device has a number N of row diodes 34*a*. The i-th row diode 34*a* connects at least one i-th row switching element 10*a* to at least one further reference potential 32*a* common to the row switching elements 10*a*. The further reference potential 32*a* common to the row switching elements 10*a* is a further operating voltage. The further reference potential 32*a* common to the row switching elements 10*a* is equal to the further reference potential 32*a* common to the column switching elements 12*a*. A first connection of the i-th row diode 34*a* is connected to a first connection of the i-th row switching element 10*a*. A second connection of the i-th row diode 34*a* is connected to the further reference potential 32*a* common to the row switching elements 10*a*. The i-th row diode 34*a* blocks a current from the direction of the further reference potential 32*a* common to the row switching elements 10*a*. The i-th row diode 34*a* allows a current from the direction of the further reference potential 32*a* common to the row switching elements 10*a*.

Figure 3:
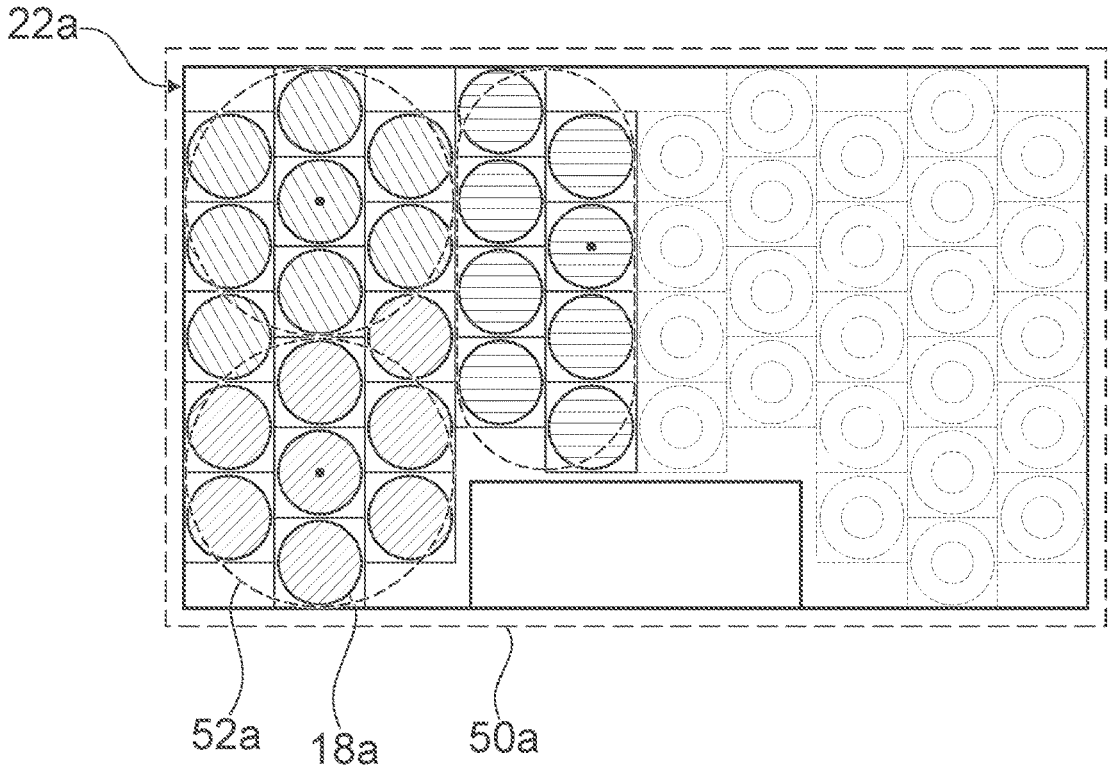
FIG. 3 shows a schematic view from above of a part of the household appliance device with an inductor matrix.

FIG. 3 shows a view from above of a part of the household appliance device with an inductor matrix 22*a*. In the present instance inductors 18*a* at position i,j of identical i are shown with identical hatching in FIG. 3. Inductors 18*a* for which i=j in the heating matrix 14*a* are also marked with a dot. The inductors 18*a* at position i,j are arranged spatially in the inductor matrix 22*a*. The inductor matrix 22*a* is different from the heating matrix 14*a* in respect of proximity relationships of at least two of the inductors 18*a* at position i,j relative to one another. In the inductor matrix 22*a* inductors 18*a* at position i,j of identical i or j are adjacent to one another. In the inductor matrix 22*a* the inductors 18*a* at position i,j are arranged spatially in such a manner that at least one inductor 18*a* at position i,j, for which i=j in the heating matrix 14*a*, is adjacent to at least one inductor 18*a* at position i,j, for which i≠j in the heating matrix 14*a*. An inductor 18*a* at position i,j, for which i=j in the heating matrix 14*a*, is surrounded, preferably surrounded in a circular manner, by multiple, in particular at least three, preferably at least four and particularly preferably at least five inductors 18*a* at position i,j, for which i≠j in the heating matrix 14*a*.

Figure 4:
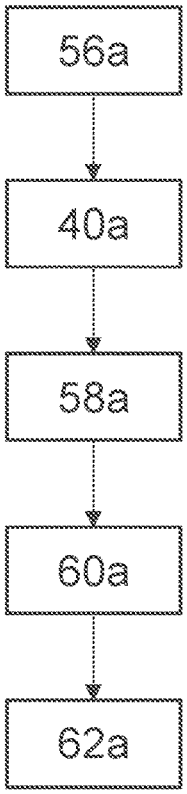
FIG. 4 shows a schematic flow chart of a method for operating a household appliance device with a cookware detection mode, FIGS. 5*a, b* show different diagrams of typical current and/or voltage profiles during operation of the household appliance device, FIGS. 6*a, b* show different diagrams of typical current and/or voltage profiles during operation of the household appliance device.

FIG. 4 shows a method for controlling the household appliance device. In the present instance the method is described with reference to exemplary operation of the electrical components with the indices i=1 and i=2 and the electrical components with the indices j=1 and j=2. The method can be applied in the same way to any further i-th electrical components and j-th electrical components.

The method comprises an operating step 56*a*. In the operating step 56*a* the control unit 38*a* activates the $2^{nd}$ row switching element 10*a* and the $1^{st}$ column switching element 12*a* as inverter switching elements. The $2^{nd}$ row switching element 10*a* and the $1^{st}$ column switching element 12*a* transition alternately through a switching operation from a first switching state to a second switching state. The $2^{nd}$ row switching element 10*a* and the $1^{st}$ column switching element 12*a* connect the heating matrix element 16*a* at position 2,1, in particular the inductor 18*a* at position 2,1, alternately to the reference potential 30*a* common to the row switching elements 10*a* and the further reference potential 32*a* common to the column switching elements 12*a*. The $2^{nd}$ row switching element 10*a* and the $1^{st}$ column switching element 12*a* generate a supply voltage, with which the heating matrix element 16*a* at position 2,1, in particular the inductor 18*a* at position 2,1, is operated. A heating current flows through the heating matrix element 16*a* at position 2,1, in particular the inductor 18*a* at position 2,1.

The method comprises a cookware detection mode 40*a*. The cookware detection mode 40*a* runs at the same time as the operating step 56*a*. Alternatively the cookware detection mode 40*a* can take place independently of the operating step 56*a*. The cookware detection mode 40*a* comprises a charging step 58*a*. In the charging step 58*a* the control unit 38*a* activates the $1^{st}$ column switching element 12*a* in such a manner that it transitions to a first switching state. The heating matrix element 16*a* at position 1,1, in particular the capacitance 28*a* at position 1,1, is charged by means of the $1^{st}$ column switching element 12*a* to the further reference potential 32*a* common to the column switching elements 12*a*. The control unit 38*a* activates the $1^{st}$ row switching element 10*a* in such a manner that it is in a second switching state and therefore does not establish a conducting connection to the reference potential 30*a* common to the row switching elements 10*a*. No current flows, with the result that the charged voltage is maintained. Similarly the heating matrix element 16*a* at position 2,2, in particular the capacitance 28*a* at position 2,2, is charged with the reference potential 30*a* common to the row switching elements 10*a*, which is made available by the $2^{nd}$ row switching element 10*a*. In the charging step 58*a* the control unit 38*a* activates the $2^{nd}$ row switching element 10*a* in such a manner that it transitions to a second switching state. The heating matrix element 16*a* at position 2,2, in particular the capacitance 28*a* at position 2,2, is charged to the reference potential 30*a* common to the row switching elements 10*a*. The control unit 38 activates the $2^{nd}$ column switching element 12*a* in such a manner that it is in the second switching state and therefore no conducting connection is established to the further reference potential 32*a* common to the column switching elements 12*a*. No current flows, with the result that the charged voltage is maintained.

The cookware detection mode 40*a* comprises a discharging step 60*a*. The discharging step 60*a* is performed during the operating step 56*a*. The operating voltage, which is present between the $2^{nd}$ row switching element 10*a* and the $1^{st}$ column switching element 12*a*, varies over time. The discharging step 60*a* is performed when the operating voltage has an at least essentially vanishingly low value. The control unit 38*a* discharges the heating matrix element 16*a* at position 1,1. To this end the control unit 38*a* switches the $1^{st}$ row switching element 10*a* to the first switching state. The $1^{st}$ row switching element 10*a* connects the heating matrix element 16*a* at position 1,1, in particular the capacitance 28*a* at position 1,1, to the reference potential 30*a* common to the row switching elements 10*a*. The heating matrix element 16*a*, in particular the capacitance 28*a* at position 1,1, discharges. A characteristic line 46*a* of the discharging operation is acquired. A further characteristic line 47*a* of the discharging operation is acquired.

The cookware detection mode 40*a* comprises a determination step 62*a*. In the determination step 62*a* a comparative characteristic line is tailored to the characteristic line 46*a* acquired in the discharging step 60*a* and in particular to the further characteristic line 47*a*. A quality of the electromagnetic coupling is determined from parameters of the comparative characteristic line. A degree of cover between the inductor 18*a* at position 1,1 and a cookware item coupled to the inductor 18*a* at position 1,1 and/or a material of the cookware item is/are also determined from the quality of the electromagnetic coupling.

Figure 5A:
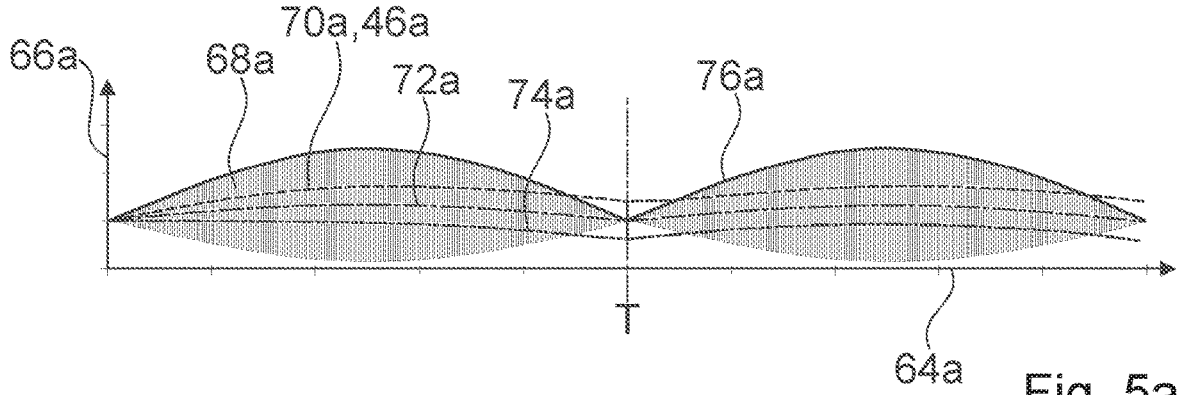
Figure 5B:
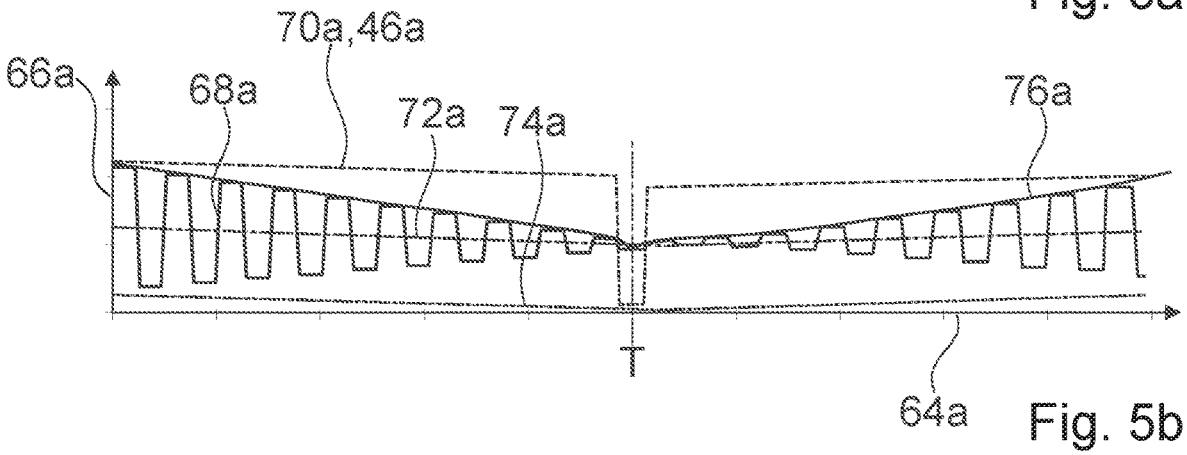

FIG. 5*a* shows a diagram of the method for controlling the household appliance device. A time is plotted on an x-axis 64*a*. A voltage is plotted on a y-axis 66*a*. A first voltage curve 68*a* shows a profile over time of the supply voltage present at the heating matrix element 16*a* at position 2,1. A second voltage curve 70*a* shows a profile over time of a voltage present at the heating matrix element 16*a* at position 1,1. A third voltage curve 72*a* shows a profile over time of a voltage present at the heating matrix element 16*a* at position 1,2. A fourth voltage curve 74*a* shows a profile over time of a voltage present at the heating matrix element 16*a* at position 2,2. A fifth voltage curve 76*a* shows a profile over time of the operating voltage. The curves 68*a*, 70*a*, 72*a*, 74*a*, 76*a* are shown again in FIG. 5*b*. FIG. 5*b* shows a region of the diagram in FIG. 5*a* about a time T, at which the operating voltage has an at least essentially vanishingly low value. In FIG. 5*b* the x-axis 64*a* has a finer scaling than in FIG. 5*a*.

Figure 6A:
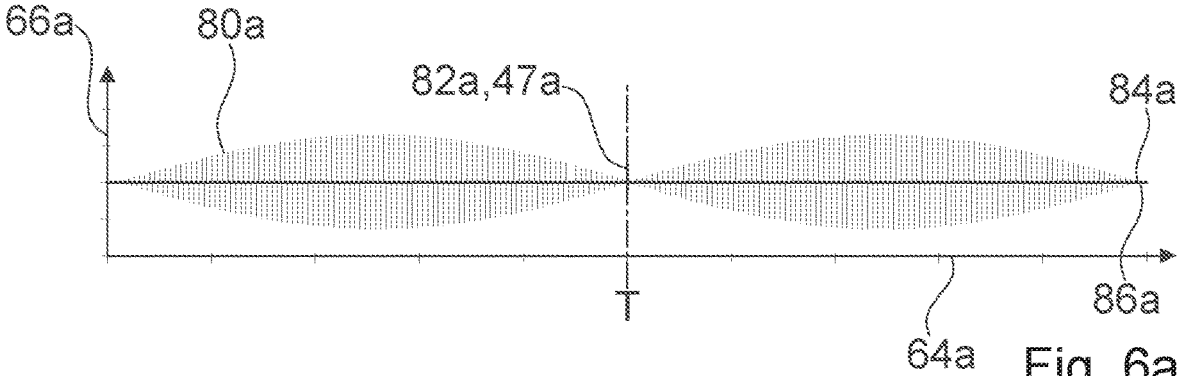
Figure 6B:
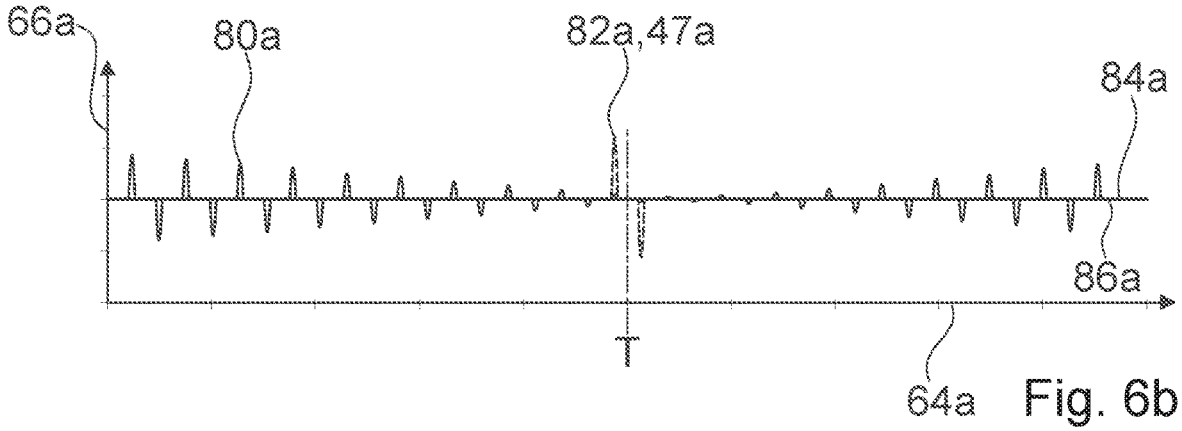

FIG. 6*a* shows a diagram of the method for controlling the household appliance device. A time is plotted on an x-axis 64*a*. A current is plotted on a y-axis 66*a*. A first current curve 80*a* shows a profile over time of the heating current flowing through the heating matrix element 16*a* at position 2,1. A second current curve 82*a* shows a profile over time of a current flowing through the heating matrix element 16*a* at position 1,1. A third current curve 84*a* shows a current flowing through the heating matrix element 16*a* at position 1,2. A fourth current curve 86*a* shows a current flowing through the heating matrix element 16*a* at position 2,2. FIG. 6*b* shows a region of the diagram in FIG. 6*a* about a time T, at which the operating voltage has an at least essentially vanishingly low value. In FIG. 6*b* the x-axis 64 has a finer scaling than in FIG. 6*a*.

The second current curve 82*a* and the second voltage curve 70*a* show the charging step 58*a* of the heating matrix element 16*a* at position 1,1. In the charging step 58*a* the heating matrix element 16*a* at position 1,1 is charged with the further reference potential 32*a* common to the column switching elements 12*a*. In the discharging step 60*a*, as soon as the operating voltage, as in the fifth voltage curve 76*a*, has an at least essentially vanishing value, the heating matrix element 16*a* at position 1,1 is discharged. A current flows, corresponding to the second current curve 82*a*. The second voltage curve 70*a* is acquired. The second characteristic voltage line serves as a characteristic line 46*a* for determining the electrical characteristic variable. The second current curve 82*a* is acquired. The second current curve 82*a* serves as a further characteristic line 47*a* for determining the electrical characteristic variable.

FIGS. 7 to 13 show further exemplary embodiments of the invention. The description that follows and the drawings are essentially restricted to the differences between the exemplary embodiments, it being possible to refer, in respect of identically marked components, in particular components with identical reference characters, in principle also to the drawing and/or description of the other exemplary embodiments, in particular in FIGS. 1 to 6. To distinguish between the exemplary embodiments the letter a is used after the reference characters of the exemplary embodiments in FIGS. 1 to 6. The letter a is replaced by the letters b, f, g, h, k, p and q in the exemplary embodiments in FIGS. 7 to 13.

Figure 7:
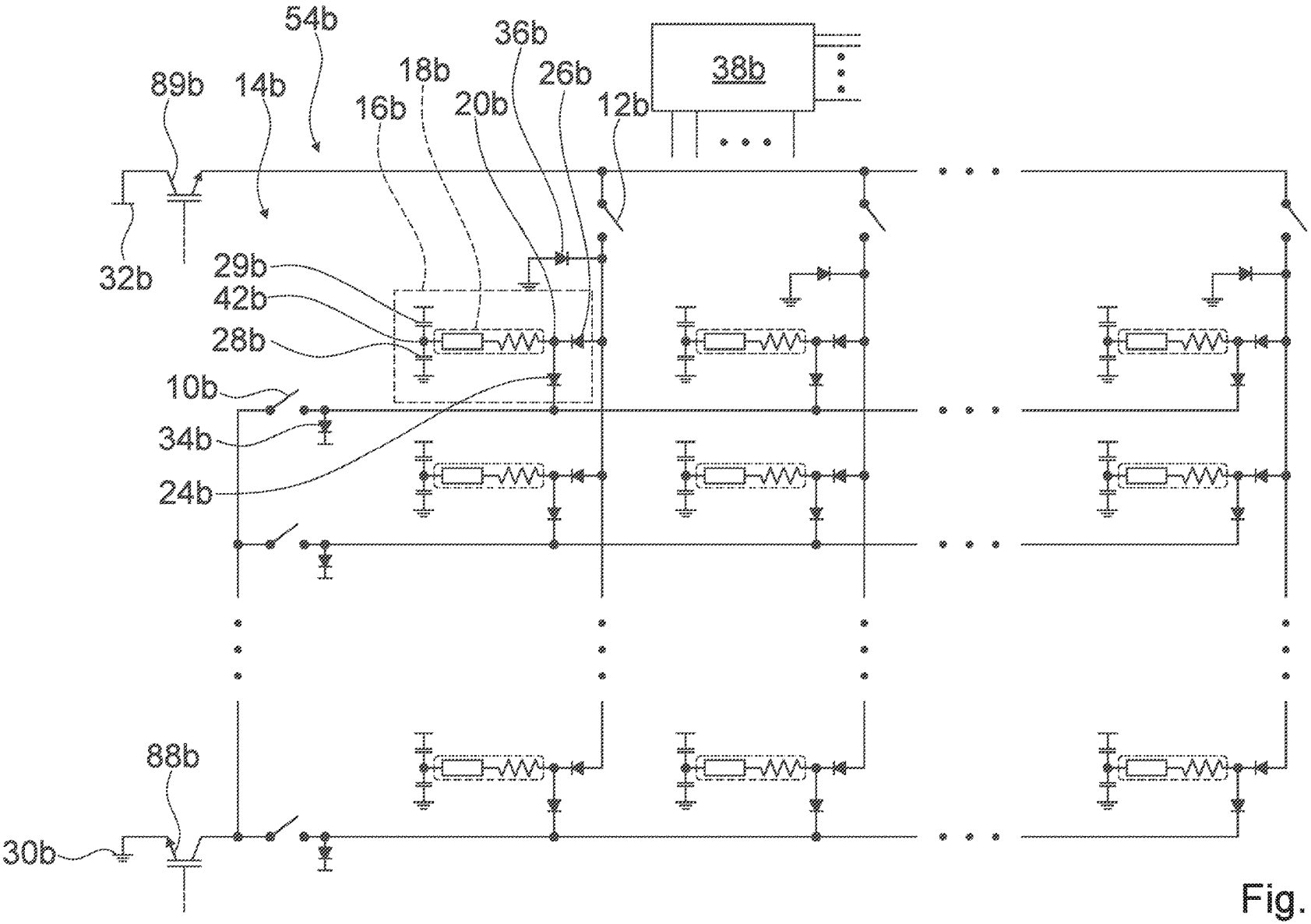
FIG. 7 shows a circuit diagram of a further household appliance device.

FIG. 7 shows a circuit diagram of a further exemplary embodiment of the invention. The further exemplary embodiment differs from the previous exemplary embodiment at least essentially in respect of a number N and a number M. In the present instance a number N of row switching elements 10*b* is equal to the number M of column switching elements 12*b*. The total number N+M of row switching elements 10*b* and column switching elements 12*b* is also smaller than or equal to the number N×M of heating matrix elements 16*b*. In the present instance the number N=4 and the number M=4. In the present instance at least the i-th row switching element 10*b*, in particular all the row switching elements 10*b*, and/or at least the j-th column switching element 12*b*, in particular all the column switching elements 12*b*, is/are configured as switches, preferably relays. The household appliance device also has an additional inverter unit 54*b*. The inverter unit 54*b* has a first inverter element 88*b*. The inverter unit 54*b* also has a second inverter element 89*b*. The inverter elements 88*b*, 89*b* are configured as transistors. The inverter element 88*b* connects the row switching elements 10*b* to a reference potential 30*b* common to the row switching elements 10*b*. The further inverter element 89*b* connects the column switching elements 12*b* to a further reference potential 32*b* common to the column switching elements 12*b*.

Figure 8:
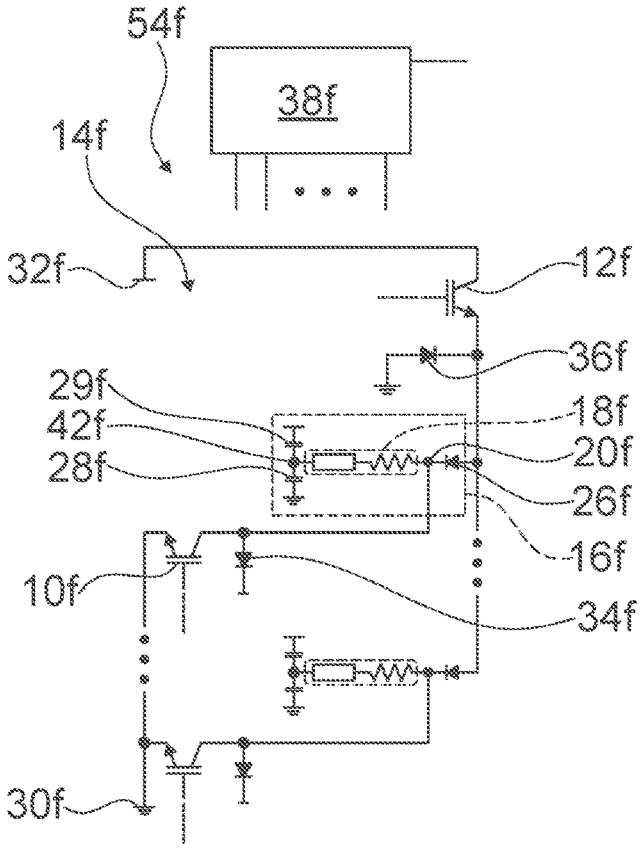
FIG. 8 shows a circuit diagram of a further household appliance device.

FIG. 8 shows a further exemplary embodiment of the invention. The further exemplary embodiment differs from the previous exemplary embodiment at least essentially in respect of a number N and a number M. The total number N+M of row switching elements 10*f* and column switching elements 12*f* is one greater than the number N×M of heating matrix elements 16*f*. In the present instance the number N=2 and the number M=1. The heating matrix 14*f* forms a schematic circuit vector, in particular a column vector. In a configuration, in which the total number N+M is one greater than the number N, diodes 24*f* at position i,1 can be dispensed with.

Figure 9:
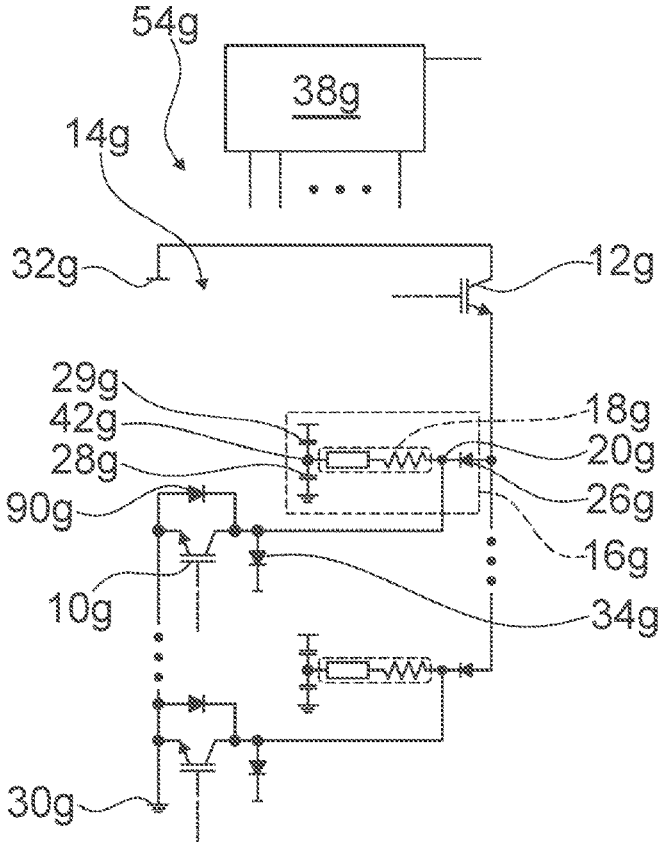
FIG. 9 shows a circuit diagram of a further household appliance device.

FIG. 9 shows a further exemplary embodiment of the invention. The further exemplary embodiment differs from the previous exemplary embodiment at least essentially in respect of a number N and a number M. The total number N+M of row switching elements 10*g* and column switching elements 12*g* is one greater than the number N×M of heating matrix elements 16*g*. In the present instance the number N=2 and the number M=1. The heating matrix 14*g* forms a schematic circuit vector, in particular a column vector. In a configuration, in which the total number N+M is one greater than the number N, diodes 24*g* at position i,1 can be dispensed with. The household appliance device has a number N of backflow diodes 90*g*. The i-th backflow diode 90*g* is connected to the i-th row switching element 10*g*. The i-th backflow diode 90*g* is connected parallel to the i-th row switching element 10*g*. A first connection of the backflow diode 90*g* is connected to a first connection of the i-th row switching element 10*g*. A second connection of the i-th backflow diode 90*g* is connected to a second connection of the i-th row switching element 10*g*. The i-th backflow diode 90*g* blocks a current flow in the direction of the reference potential 30*g* common to the row switching elements 10*g*. The i-th backflow diode 90*g* allows a current flow from the direction of the reference potential 30*g* common to the row switching elements 10*g*. Alternatively or additionally the household appliance device can have a number of further backflow diodes 90*g*. A j-th further backflow diode 90*g* could be connected parallel to a j-th column switching element 12*g*. A column diode can also be dispensed with in the present instance.

Figure 10:
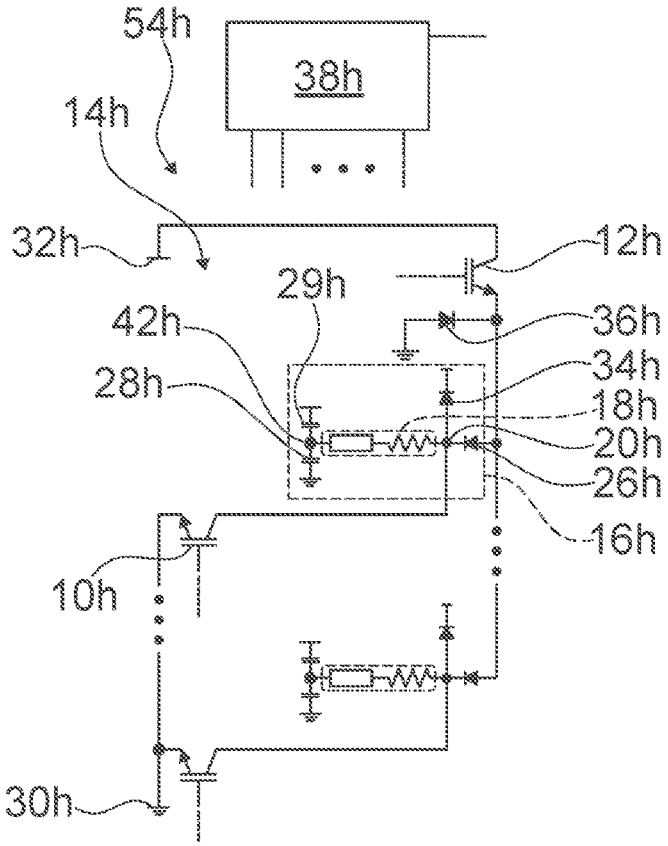
FIG. 10 shows a circuit diagram of a further household appliance device.

FIG. 10 shows a further exemplary embodiment of the invention. The further exemplary embodiment differs from the previous exemplary embodiment at least essentially in respect of a number of additional electrical components. The present exemplary embodiment differs by way of a circuit of row diodes 34*h*. In the present instance the i-th row diode 34*h* is connected to a connection 20*h* at position i,j of an inductor 18*h* at position i,j. A first connection of the i-th row diode 34*h* is connected to the connection 20*h* at position i,j. A second connection of the i-th row diode 34*h* is connected to a further reference potential 32*h* common to the row switching elements 10*h*. The i-th row diode 34*h* blocks a current from the direction of the further reference potential 32*h* common to the row switching elements 10*h*. The i-th row diode 34*h* allows the passage of a current from the direction of the further reference potential 32*h* common to the row switching elements 10*h*.

Figure 11:
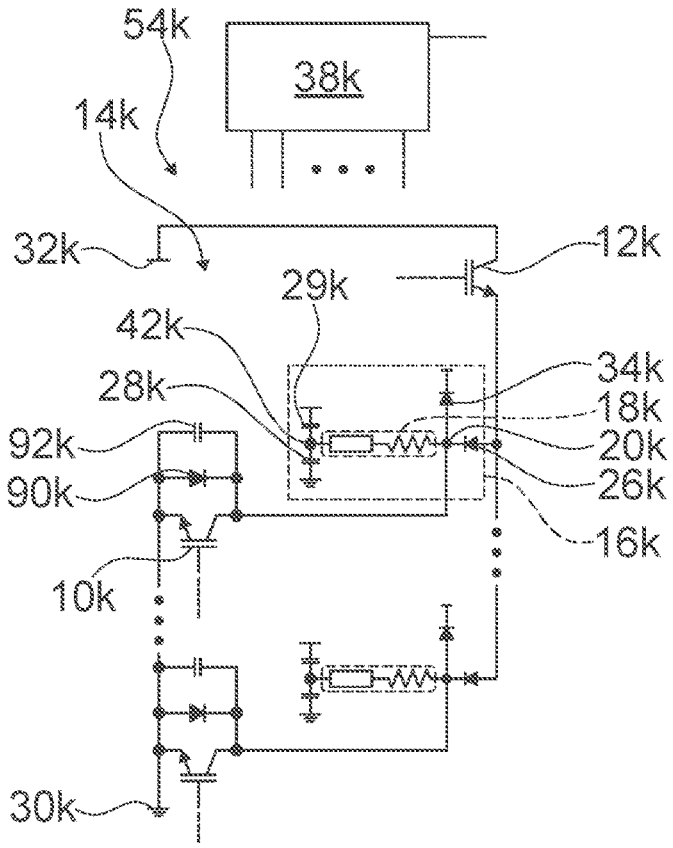
FIG. 11 shows a circuit diagram of a further household appliance device.

FIG. 11 shows a further exemplary embodiment of the invention. The further exemplary embodiment differs from the previous exemplary embodiment at least essentially in respect of a number of additional electrical components. The household appliance device has a number N of row capacitances 92*k*. The i-th row capacitance 92*k* is connected parallel to an i-th row switching element 10*k*. An i-th backflow diode 90*k* is also connected parallel to an i-th row switching element 10*k*. A first connection of the i-th row capacitance 92*k* is connected to a first connection of the i-th row switching element 10*k*. A second connection of the i-th row capacitance 92*k* is connected to a second connection of the i-th row switching element 10*k*. A column diode can also be dispensed with in the present instance.

Figure 12:
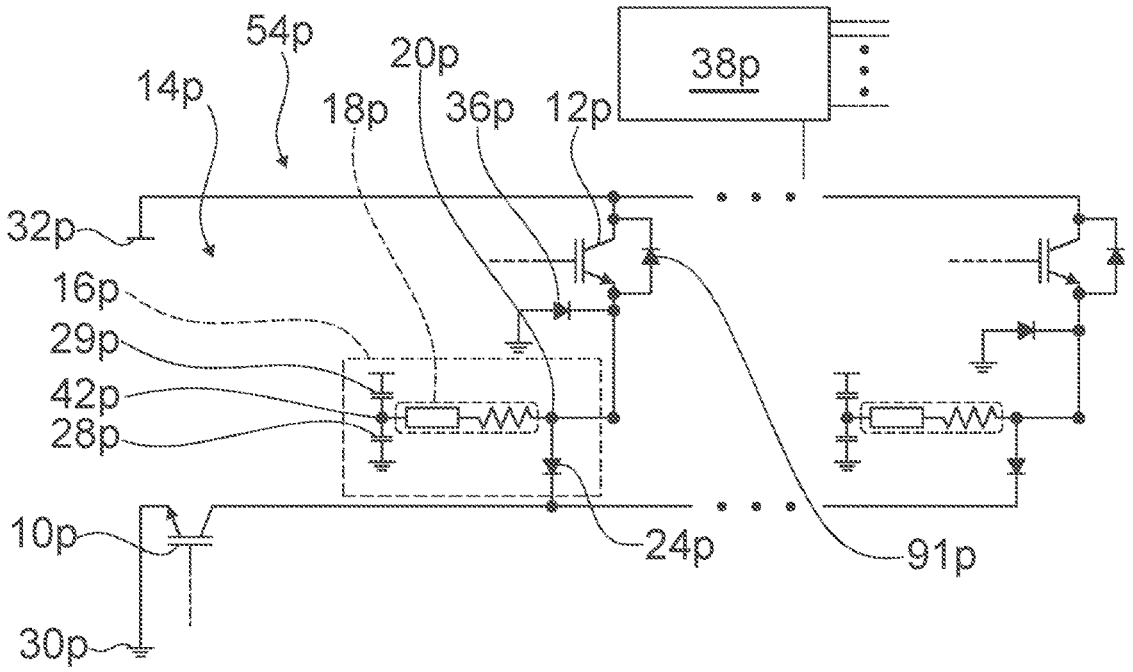
FIG. 12 shows a circuit diagram of a further household appliance device and FIG. 13 shows a circuit diagram of a further household appliance device.

FIG. 12 shows a further exemplary embodiment of the invention. The further exemplary embodiment differs from the previous exemplary embodiment at least essentially in respect of a number N and a number M. The total number N+M of row switching elements 10*p* and column switching elements 12*p* is one greater than the number N×M of heating matrix elements 16*p*. In the present instance the number N=1 and the number M=2. The heating matrix 14*p* forms a schematic circuit vector, in particular a row vector. In a configuration, in which the total number N+M is one greater than the number N, further diodes at position j,1 can be dispensed with. The household appliance device has a number M of further backflow diodes 91*p*. The j-th further backflow diode 91*p* is connected to the j-th column switching element 12*p*. The j-th further backflow diode 91*p* is connected parallel to the j-th column switching element 12*p*. A first connection of the further backflow diode 91*p* is connected to a first connection of the j-th column switching element 12*p*. A second connection of the j-th further backflow diode 91*p* is connected to a second connection of the j-th column switching element 12*p*. The j-th further backflow diode 91*p* allows a current flow in the direction of the reference potential 32*p* common to the column switching elements 12*p*. The j-th further backflow diode 91*p* blocks a current flow from the direction of the reference potential 32 common to the column switching elements 12*p*. Alternatively or additionally the household appliance device can have a number of backflow diodes 90*p*. An i-th backflow diode 90*p* could be connected parallel to an i-th row switching element 10*p*. A row diode can also be dispensed with in the present instance.

Figure 13:
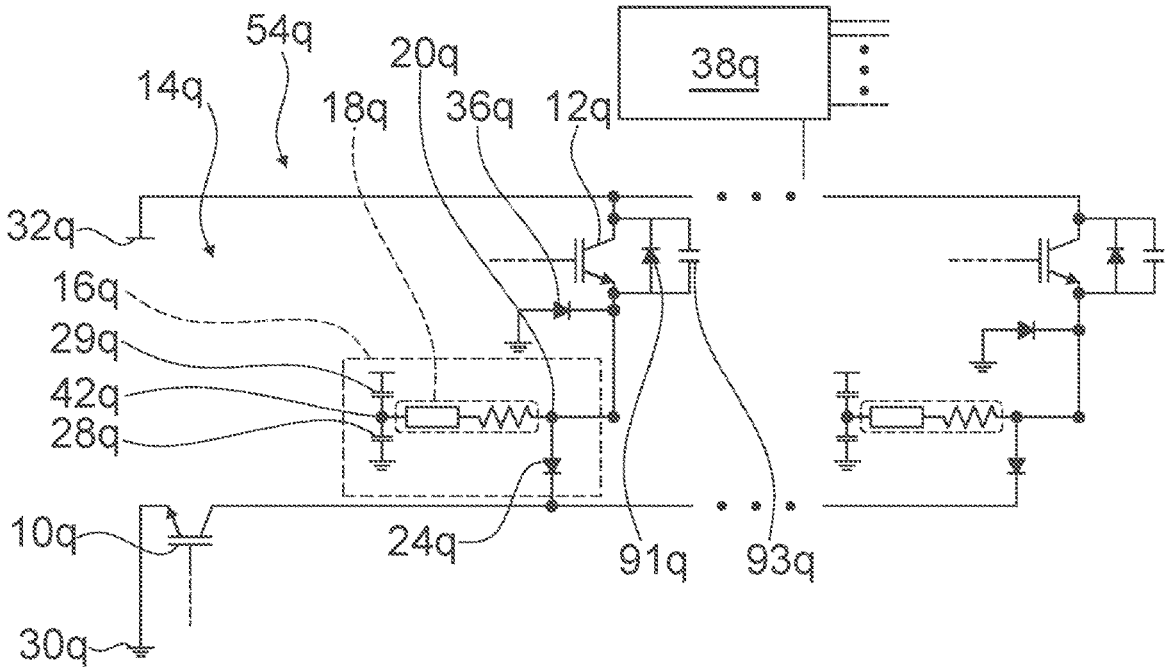

FIG. 13 shows a further exemplary embodiment of the invention. The further exemplary embodiment differs from the previous exemplary embodiment at least essentially in respect of a number of additional electrical components. The household appliance device has a number M of column capacitances 93*q*. The j-th column capacitance 93*q* is connected parallel to a j-th column switching element 12*q*. A first connection of the j-th column capacitances 93*q* is connected to a first connection of the j-th column switching element 12*q*. A second connection of the j-th column capacitances 93*q* is connected to a second connection of the j-th column switching element 12*q*. An i-th row diode 34 can also be dispensed with.

The invention claimed is:

1. A household appliance device, comprising:

an integer number N of row switching elements at a row position i, wherein i is an integer number 1≤i≤N, an integer number M of column switching elements at a column position j, wherein j is an integer number 1≤j≤M, a heating matrix comprising at least N×M heating matrix elements having positions (i, j), with N+M>2, wherein a heating matrix element at the position (i,j) comprises at least one inductor at the position (i,j) and is connected to both the i-th row switching element and the j-th column switching element, and at least one switching diode, which connects at least one of the row switching elements or at least one of the column switching elements to at least one reference potential.

2. The household appliance device of claim 1, constructed in the form of a cooking appliance device.

3. The household appliance device of claim 1, wherein the at least inductor at the position (i,j) has at least one terminal at the position (i,j) which is connected to both the i-th row switching element and the j-th column switching element.

4. The household appliance device of claim 1, wherein a plurality of inductors are spatially arranged in an inductor matrix having a proximity relationship between at least two of the inductors relative to one another that is different from an arrangement of the inductors in a schematic circuit diagram of the heating matrix.

5. The household appliance device of claim 4, wherein the plurality of inductors are spatially arranged in the inductor matrix such that at least one inductor at the position (i,j), for which i=j in the heating matrix, is adjacent to at least one inductor at the position (i,j), for which i≠j in the heating matrix.

6. The household appliance device of claim 4, wherein the inductors of the inductor matrix at positions (i,j) having identical i or identical j are located adjacent to one another.

7. The household appliance device of claim 1, wherein the number N of row switching elements is equal to the number M of column switching elements.

8. The household appliance device of claim 1, wherein a total number N+M of row switching elements and column switching elements is greater by one than a number N×M of heating matrix elements.

9. The household appliance device of claim 1, wherein the heating matrix element at the position (i,j) comprises at least one diode at the position (i,j), which connects a respective inductor at position (i,j) at least to the i-th row switching element.

10. The household appliance device of claim 1, wherein the heating matrix element at the position (i,j) comprises at least one further diode connecting the inductor at the position (i,j) at least to the j-th column switching element.

11. The household appliance device of claim 1, wherein the heating matrix element at the position (i,j) comprises at least one capacitance at the position (i,j) connecting the inductor at the position (i,j) at least to at least one reference potential that is common to the heating matrix elements.

12. The household appliance device of claim 1, further comprising a number M of column diodes at the column position j, with the j-th column diode connecting at least the j-th column switching element to at least one reference potential that is common to the column switching elements.

13. The household appliance device of claim 12, further comprising a number N of row diodes at the row position i, with the i-th row diode connecting at least the i-th row switching element to at least one further reference potential common to the row switching elements.

14. The household appliance device of claim 12, further comprising a control unit configured to control the row switching elements and the column switching elements.

15. The household appliance device of claim 14, wherein the control unit is configured to control the row switching elements and the column switching elements as inverter switching elements.

16. The household appliance device of claim 14, wherein the control unit is configured to determine, in at least one cookware detection mode, at least one electrical characteristic variable occurring on at least one of the inductors, when an operating voltage assumes an almost negligible low value.

17. The household appliance device as claimed in claim 16, wherein the control unit is configured to, in the cookware detection mode, to first charge the inductor and thereafter discharge the inductor again, when the operating voltage assumes an almost negligible low value.

18. The household appliance device of claim 17, wherein the control unit is configured to measure, in the cookware detection mode, a characteristic curve of a discharging operation of the inductor and to determine the electrical characteristic variable form the characteristic curve.

19. A household appliance, comprising a household appliance device which includes an integer number N of row switching elements at a row position i, wherein i is an integer number $1 \leq i \leq N$, an integer number M of column switching elements at a column position j, wherein j is an integer number $1 \leq j \leq M$, a heating matrix comprising at least $N \times M$ heating elements having positions (i, j), with $N+M>2$, wherein a heating matrix element at the position (i,j) comprises at least one inductor at the position (i,j) and is connected to both the i-th row switching element and the j-th column switching element, and at least one switching diode, which connects at least one of the row switching elements or at least one of the column switching elements to at least one reference potential.

20. The household appliance of claim 19, wherein the household appliance device is constructed in the form of a cooking appliance.

* * * * *